US005095554A

United States Patent [19]

Gloor

[11] Patent Number: 5,095,554

[45] Date of Patent: Mar. 17, 1992

[54] SANITARY FITTING

[75] Inventor: Roland Gloor, Zetzwil, Switzerland

[73] Assignee: KWC AG, Unterkulm, Switzerland

[21] Appl. No.: 696,934

[22] Filed: May 8, 1991

[30] Foreign Application Priority Data

May 8, 1990 [CH] Switzerland ..... 01556/90

[51] Int. Cl.[5] ..... E03C 1/10; E03C 1/04; F16K 11/18; F16K 24/00

[52] U.S. Cl. ..... 4/192; 4/195; 137/801; 137/218

[58] Field of Search ..... 4/192, 191, 654, 195; 137/216, 217, 218, 801

[56] References Cited

U.S. PATENT DOCUMENTS

| | | | |
|---|---|---|---|
| 3,424,188 | 1/1969 | Whitaker et al. | 137/218 |
| 3,818,929 | 6/1974 | Braukmann | 137/218 |
| 3,862,640 | 1/1975 | Hechler | 137/218 X |
| 3,967,638 | 7/1976 | Tondreau | 137/216 |
| 4,013,089 | 3/1977 | Braukmann | 137/218 |
| 4,262,699 | 4/1981 | Fabian | 4/192 X |
| 4,635,673 | 1/1987 | Gerdes | 137/216 |
| 4,827,538 | 5/1989 | Heimann et al. | 4/191 X |
| 4,977,920 | 12/1990 | Oberdörfer | 137/218 |
| 5,009,247 | 4/1991 | Oberdörfer | 137/218 |
| 5,014,749 | 5/1991 | Humpert et al. | 137/801 |

FOREIGN PATENT DOCUMENTS

| | | | |
|---|---|---|---|
| 0390248 | 10/1990 | European Pat. Off. | 4/191 |
| 3509649 | 9/1986 | Fed. Rep. of Germany | 4/191 |
| 3603503 | 8/1987 | Fed. Rep. of Germany | 4/192 |
| 3726436 | 2/1988 | Fed. Rep. of Germany | 4/191 |
| 8813390 | 2/1989 | Fed. Rep. of Germany . | |
| 3822872 | 1/1990 | Fed. Rep. of Germany | 4/192 |
| 0173652 | 3/1935 | Switzerland | 4/192 |

*Primary Examiner*—William A. Cuchlinski, Jr.
*Assistant Examiner*—John L. Beres
*Attorney, Agent, or Firm*—Oblon, Spivak, McClelland, Maier & Neustadt

[57] ABSTRACT

The fitting with the hose shower comprises a fitting housing at which there is arranged a laterally actuatable control cartridge. Downstream of the control cartridge, viewed with respect to the direction of water flow, there is provided a safety device arranged above the control cartridge. Under normal operating conditions, water flows from the control cartridge via the safety device to an outlet. Under conditions rendering possible a backflow, a backflow preventer of the safety device cuts off the flow path of water and a pipe aerator connects the outflow line or conduit via an aeration path with the environment. As a result, there is precluded a backflow of water into the supply or feed line.

13 Claims, 3 Drawing Sheets

SANITARY FITTING

BACKGROUND OF THE INVENTION

The present invention broadly relates to fittings or faucets or appliances and, more specifically, pertains to a new and improved construction of a sanitary fitting.

Generally speaking, the sanitary fitting of the present development is of the type comprising a control cartridge which is arranged in a fitting housing or body, is actuatable from a lateral end of the fitting housing, and is connected at the inlet side thereof with at least one supply or feed line, the control cartridge serving to regulate water flowing through the fitting to an outlet. The fitting also comprises a safety device which is likewise provided in the fitting housing and arranged downstream of the control cartridge, viewed with respect to the predetermined direction of flow, the safety device serving to prevent a backflow of water into the aforementioned at least one supply or feed line. The safety device comprises a ventilation aperture which is closed in the presence of normal water flow and which, under conditions rendering possible a backflow of water, is open for ventilating at least the outflow line or conduit connecting the safety device with the outlet.

There are heretofore known sanitary fittings in which a back or return suction of dirty or contaminated water into the supply or feed line can endanger the quality of feed-water. Such appliances can be particularly washbasin fittings and sink fittings comprising a pull-out hose shower or sprayer, as well as shower and tub mixing faucets and combination sets including a hose shower. In such fittings it can occur that the shower is left lying in a washbasin or tub when, for example, the water supply or feed line is cut off or interrupted. If at such a moment the control cartridge of the sanitary fitting is open, the washbasin or the tub can be sucked dry through the shower because of negative pressure or partial vacuum in the supply or feed line. Such fittings or faucets should include safety devices by means of which there is precluded back suction of soiled or contaminated water to the supply o feed line.

A fitting of this type is known from and disclosed to the art in, for example, German Published Patent Application No. 3,603,503, published Aug. 6, 1987. This known mixing faucet with hose-shower outlet comprises a fitting housing mounted at a sink-basin table, in which housing there is arranged a control cartridge actuatable from one side of the housing. This control cartridge is connected at the inlet side thereof with supply or feed lines for hot water and cold water, whereby mixed water leaving the control cartridge arrives at a mixing or discharge chamber arranged within the housing and partially enclosing the control cartridge. Mixed water is then delivered or conducted from the mixing or discharge chamber through an outflow hose to the outlet or spout provided in a hose shower. In the fitting housing there is provided a safety device located below the control cartridge and arranged in flow connection with the mixing or discharge chamber, such safety device being arranged about 3 cm to 5 cm above the highest possible water level in the sink basin and having a ventilation aperture leading out of the fitting. Under normal operating conditions, the ventilation aperture is closed by means of a sealing member. Such sealing member bears upon an annular shoulder or seat bounding the ventilation aperture. When now a negative pressure occurs in the supply or feed line and the control cartridge remains open, the sealing member is lifted off from the annular shoulder or seat, so that the flow path of water is connected with the environment by means of the ventilation aperture. The supply or feed line as well as the outflow hose are thus ventilated, in order to preclude a back-suction of water into the supply or feed line.

In this prior art construction of a mixing faucet with hose-shower outlet there are only relatively slight or small pressure differences available or disposable for lifting off the sealing member from the annular shoulder or seat, in order to ventilate the supply or feed line and the outflow hose under conditions that render possible a backflow. These only slight pressure differences available require an extremely easy-running or high-sensitive construction of the safety device, whereby the operational reliability is particularly made uncertain by furring in the fitting. The required smooth running of the known safety device is moreover a disadvantage in that, upon rapidly cutting off the flow of water when the control cartridge is closed, the sealing member is lifted from the annular shoulder or seat by negative pressure build-up in the outflow hose, so that leaking water can flow out of the fitting through the safety device even under quite normal operating conditions.

SUMMARY OF THE INVENTION

Therefore, with the foregoing in mind, it is a primary object of the present invention to provide a new and improved construction of a sanitary fitting which does not suffer from the aforementioned drawbacks and shortcomings of prior art constructions.

Another and more specific object of the present invention aims at providing a new and improved construction of a sanitary fitting of the type described, which possesses a substantially improved operational reliability as well as a substantially uprated operating safety.

Yet a further significant object of the present invention aims at providing a new and improved construction of a sanitary fitting which is relatively simple in structure and design, economical to manufacture and not readily subject to malfunction.

Now to implement these and still further objects of the invention, which will become more apparent as the description proceeds, the sanitary fitting of the present invention is manifested, among other things, by the feature that the safety device is provided above the control cartridge.

By virtue of arranging the safety device above the control cartridge, there is achieved a substantially large elevational difference between the safety device and the highest possible water level. As a result, there is an adequately large pressure difference to ensure reliable operation of the safety device. Moreover, more stringent or exacting standards can be fulfilled by virtue of the inventive arrangement of the safety device.

The outflow line or conduit advantageously possesses a section leading away from the safety device and extending within the fitting housing or body downwards and past the control cartridge to a pull-out hose shower comprising the outlet, whereby the aforesaid section preferably constitutes an outflow-line section configured at the fitting housing or body.

In the fitting housing or body there is provided an aeration path which is flow-connected with the ventilation aperture of the safety device. Such aeration path is preferably structured to lead out of the housing or body at the front side of the latter.

The fitting housing or body comprises a lower housing part at which there are arranged the control cartridge and the safety device, and an upper housing part through which the aforesaid outflow-line section extends, whereby the upper housing part is pivotably mounted at the lower housing part for swiveling movement about a substantially vertical axis of the upper housing part. The upper housing part is bent away either at a location above the safety device or at a location within the region of the safety device, thus constituting a connection piece which projects inclinedly upwards and removably retains a shower head.

A preferred exemplary embodiment of the sanitary fitting constructed according to the invention is characterized in that in the lower housing part there are provided a connecting channel or duct possessing an open upper end, and a recess for accommodating the safety device, such recess likewise having an open upper end. The connecting channel or duct leads away from the control cartridge and is guided past the recess. There is provided a cover element for mutually covering the two open upper ends such that the connecting channel or duct and the recess are flow-connected with one another, whereby the outflow-line section leading away from the safety device is respectively adapted to lead away from the recess.

In a further exemplary embodiment of the sanitary fitting constructed according to the invention, the lower housing part of the fitting housing or body advantageously comprises an extension which projects into the upper housing part of the fitting housing or body, whereby such extension located within the upper housing part comprises a recess at which the safety device is arranged. The extension also comprises a connecting channel or duct extending through the latter from the control cartridge and guided past the recess. The connecting channel and the recess each have an open upper end, and the extension is provided with a cover element for mutually covering these two open upper ends such that the recess and the connecting channel are flow-connected with each other. The aforesaid outflow-line section preferably extends through the extension and leads away from the recess.

The flow path of water from the at least one supply or feed line extends from the control cartridge to the outlet via the connecting channel or duct, through the safety device, then through the outflow line including the section thereof, and thereafter through the pull-out hose shower comprising the outlet.

The safety device comprises a pipe interruptor provided in the aforementioned flow path of water as well as a pipe aerator provided in the aeration path.

In a similar preferred embodiment of the invention, the safety device comprises a backflow preventer located in the flow path of water and a pipe aerator provided in the aeration path.

In a particularly advantageous embodiment of the inventive sanitary fitting, the recess is substantially vertically arranged and the safety device inserted in the recess comprises a pipe aerator and a backflow preventer. The backflow preventer, arranged above the pipe aerator and provided in the flow path of water, comprises a valve body and a valve seat, whereby the valve body is preferably prestressed against the valve seat and cooperates with the latter in order to let pass the water flowing in the predetermined direction of flow and to automatically close under conditions rendering possible a backflow. The pipe aerator comprises a throughpassage connected with the aeration path and bounded or limited by the ventilation aperture. The pipe aerator further comprises a sealing element closing the ventilation aperture under normal operating conditions. The sealing element is structured to be lifted from the sealing aperture under conditions rendering possible a backflow, in order to ventilate the portion of the outflow line arranged downstream of the backflow preventer, as viewed in the predetermined direction of flow.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of the sanitary fitting has been illustrated therein as is needed to enable one skilled in the art to readily understand the underlying principles and concepts of this invention.

Figure 1:
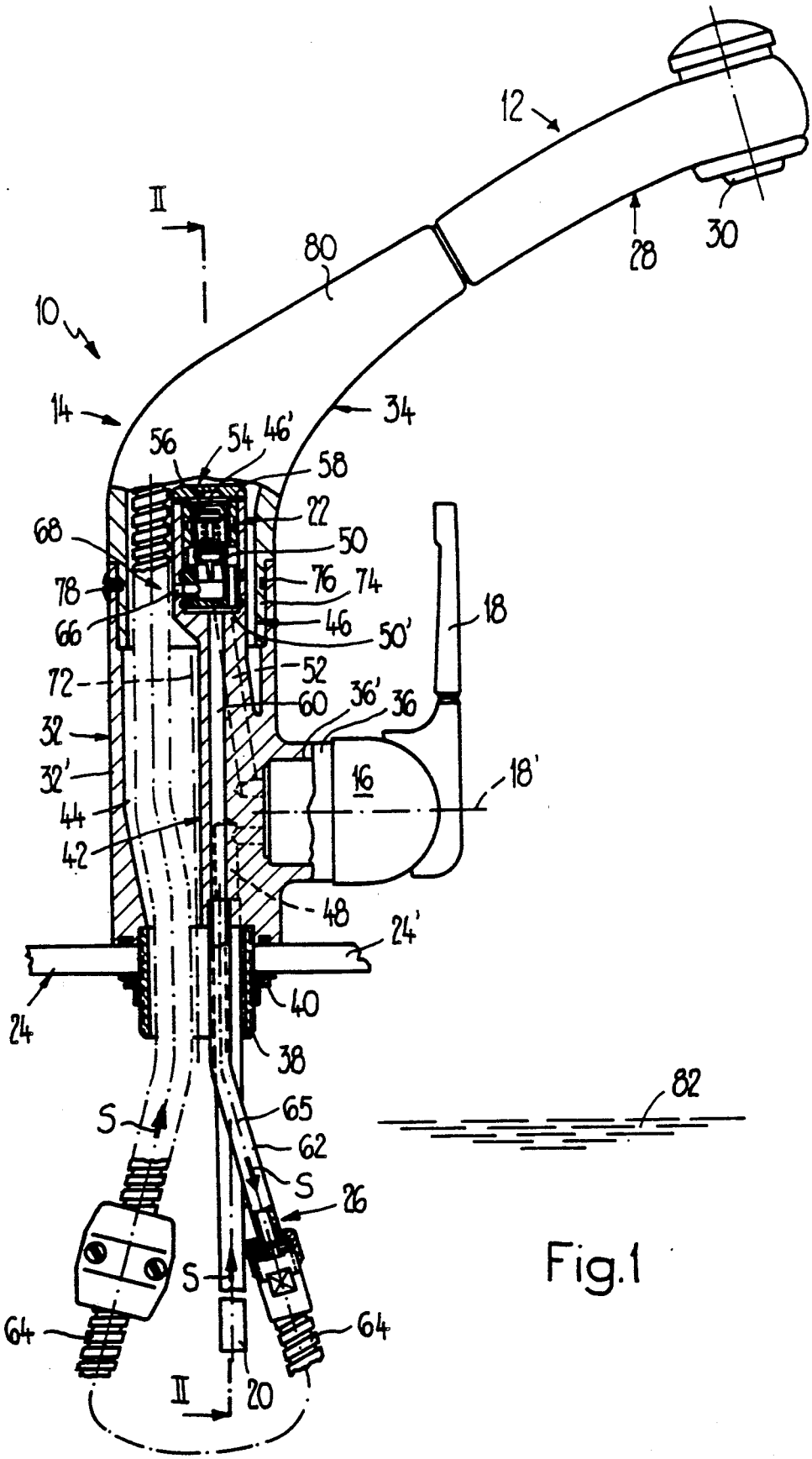
FIG. 1 shows in a side view, partially in section, a sanitary fitting constructed according to the invention.
Figure 2:
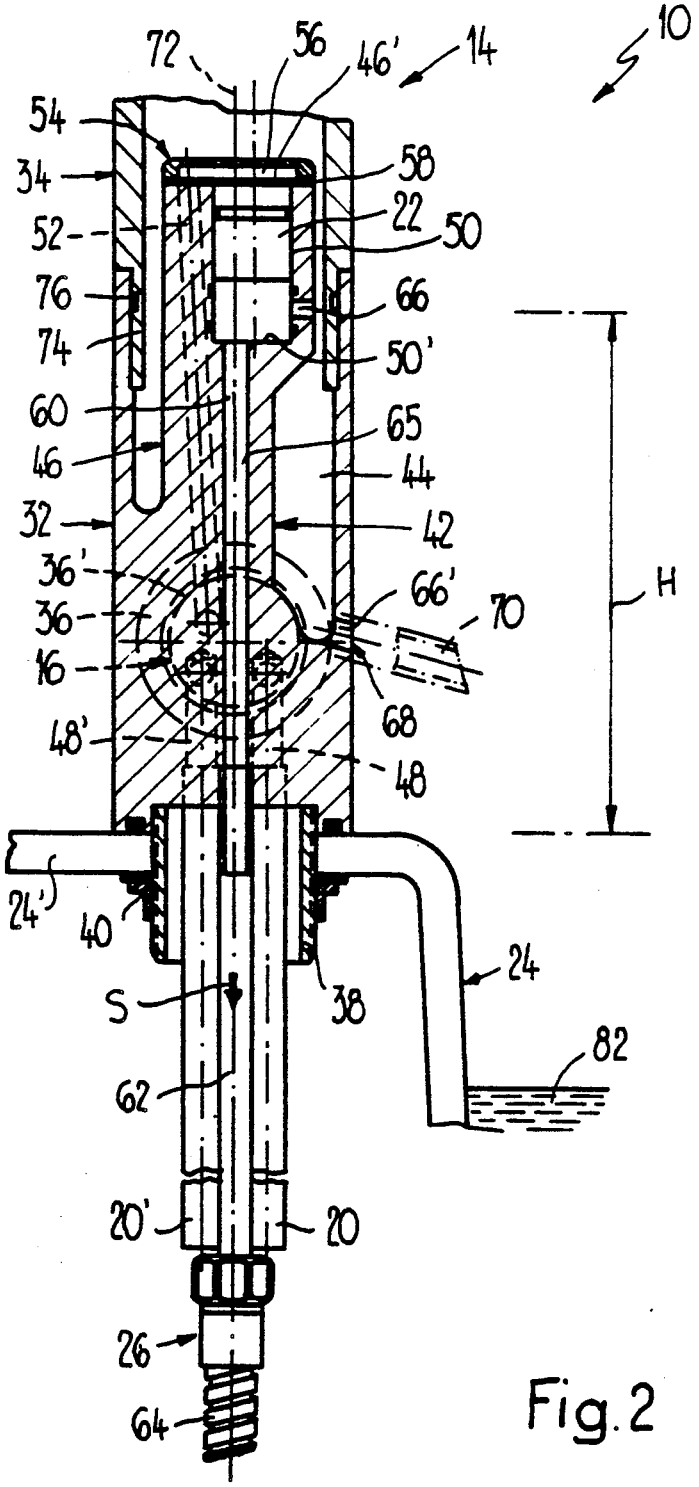
FIG. 2 shows a vertical cross-section taken substantially along the line II—II in FIG. 1.

Turning attention now specifically to FIGS. 1 and 2 of the drawings, the apparatus illustrated therein by way of example and not limitation will be seen to comprise a sanitary fitting or faucet 10 with a pull-out or draw-out hose shower 12. This sanitary fitting 10 comprises a fitting housing or body 14, at which there is arranged a control cartridge 16 of generally known structure. The control cartridge 16 is actuatable from a side of the fitting housing or body 14. By turning an operating or control lever 18 of the control cartridge 16 about a substantially horizontal axis 18', there is set the ratio of mixture between cold water and hot water delivered by respective supply or feed lines 20 and 20'. On the other hand, by pivoting the operating or control lever 18 about an axis extending substantially perpendicular to the horizontal axis 18', there is set the quantity of mixed water flowing out of the sanitary fitting or faucet 10.

Figure 3:
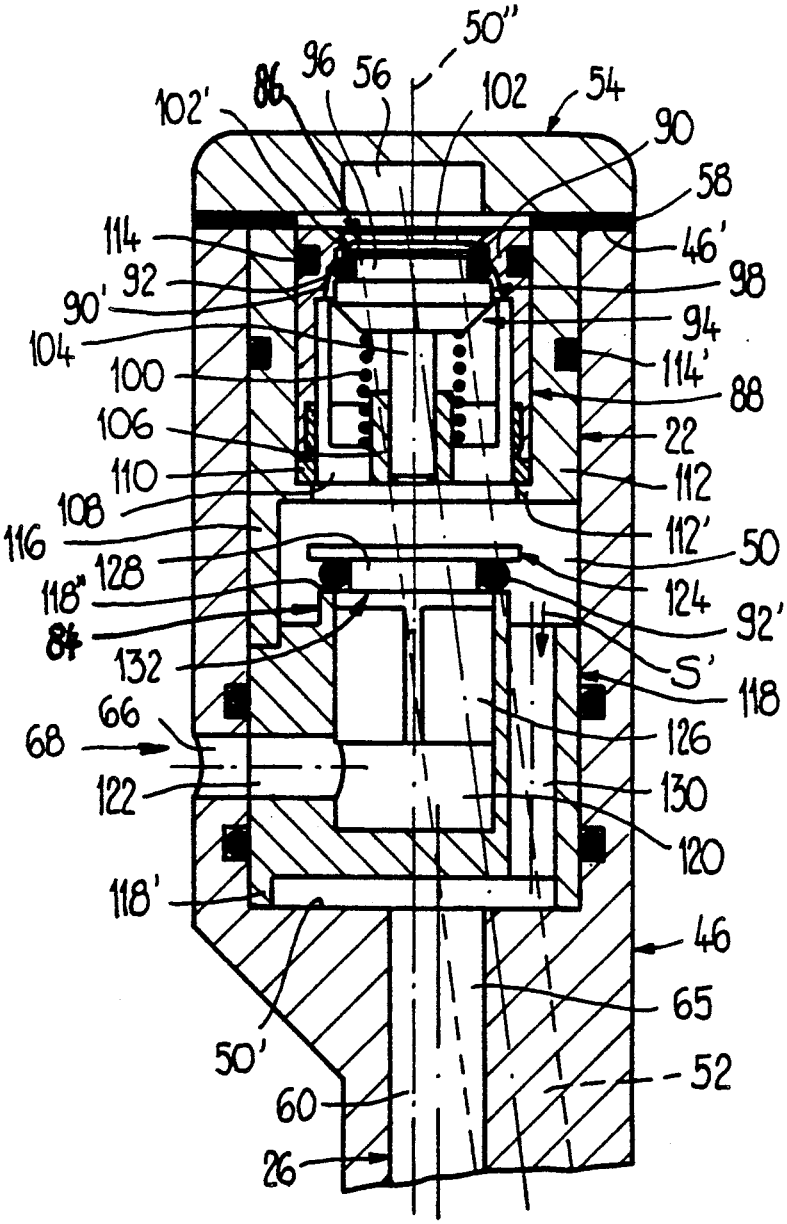
FIG. 3 shows, in an enlarged illustration and partially in section, a side view of a portion of the sanitary fitting shown in FIG. 1.

Viewed with respect to the direction of flow S of mixed water, a safety or check device 22 is arranged downstream of the control cartridge 16. The safety device 22 is provided within the fitting housing or body 14 and located above the control cartridge 16. This safety device 22 is depicted in FIG. 3 in an enlarged illustration and a detailed description thereof will follow hereinbelow. By virtue of this arrangement of the safety device 22, there is achieved a considerable height H indicated in FIG. 2, such height H specifying the vertical distance between the safety device 22 and the highest possible water level in a sink-basin 24 or equivalent structure, at which the sanitary fitting 10 is mounted. Such arrangement of the safety device 22 within the fitting housing or body 14 also allows maintaining an aesthetically appealing form of the fitting or faucet 10.

The object of the safety or check device 22, under conditions rendering possible a so-called backflow or reflux action, is to effectively prevent a back-suction of water from the sink-basin 24 into the supply or feed lines 20 and 20', and to simultaneously ventilate an outflow line or conduit 26 arranged downstream of the safety device 22, viewed in the predetermined direction of flow S of mixed water. The outflow line or conduit 26 conducts mixed water from the safety device 22 to an outlet 30 arranged at a shower head 28 of the pull-out hose shower 12.

The fitting housing or body 14 comprises two preferably cast housing parts 32 and 34. The lower housing part 32 having a housing wall 32' is structured to be substantially cylindrical and comprises a laterally projecting, with respect to the horizontal axis 18' cylindrically hollow accommodating connection-piece 36 containing a recess 36' in which the control cartridge 16 is fixedly accommodated. A hollow cylinder-shaped retaining sleeve 38 penetrating a horizontally extending rim 24' of the sink-basin 24 is screwed into the lower housing part 32 standing substantially in a vertical direction on the rim 24'. At the underside of this rim 24', a flanged nut 40 is screwed on the retaining sleeve 38 in order to fasten or mount the fitting housing or body 14 at the sink-basin or wash-basin 24.

The lower housing part 32 is structured to be essentially hollow. However, at the inner-wall side assigned to the accommodating connection-piece 36, a rib 42 projects from the housing wall 32' into a hollow space 44 enclosed or bordered by the housing wall 32', such rib 42 extending up to slightly above the connection-piece 36. At the rib 42 there is formed an extension 46 projecting in an upward direction and arranged in a spaced relationship with respect to the housing wall 32', whereby the safety device 22 is arranged in the upwardly projecting extension 46. Within the rib 42 there are provided two side-by-side extending supply-line channels or ducts 48 and 48', with which the two supply or feed lines 20 and 20' guided through the retaining sleeve 38 are connected, in order to feed hot and cold water to the control cartridge 16. In the extension 46 projecting in an upward direction, there is provided a blind-hole-type recess 50 which extends in a vertical direction and is open toward the top for receiving the safety device 22.

A connecting channel or duct 52 from the outlet side of the control cartridge 16 extends through the rib 42, then through the upwardly projecting extension 46, and thereafter is guided past the recess 50. This connecting channel or duct 52 leads out of the extension 46 at an upper planar end 46'. A cover element 54 sitting on the upwardly projecting extension 46 is secured to the latter by means of, for example, screws or any other suitable fastening elements. This cover element 54 covers the recess 50 and the aforesaid upper planar end 46' of the connecting channel or duct 52, and comprises at the underside thereof a flow groove or channel 56 which flow-connects the connecting channel or duct 52 with the recess 50. In order to prevent a leak of mixed water, there is arranged a sealing element 58 between the upper planar end 46' of the extension 46 and the cover element 54.

The recess 50 provided in the extension 46 projecting in an upward direction possesses a base or bottom 50', from which a section 60 of the outflow line or conduit 26 extends approximately in a vertical direction through the extension 46 and then through the rib 42. This outflow-line section 60 is guided past the control cartridge 16 and between the two supply-line channels or ducts 48 and 48' extending side-by-side within the rib 42. A pipe or tube 62 guided through the cylinder-shaped retaining sleeve 38 engages from below the outflow-line section 60 and is secured thereto by means of brazing or hard soldering or any other suitable process. At the other or lower end of the pipe or tube 62 there is connected a conventional flexible hose 64 which forms a reserve loop below the sink-basin 24, and thereafter is guided through the retaining sleeve 38, then through the hollow space 44, and thereafter through the upper housing part 34, the upper end of the latter removably retaining the pull-out hose shower 12 with shower head 28. The flow path 65 of water arriving from the two supply or feed lines 20 and 20' thus extends from the control cartridge 16 via the connecting channel or duct 52 to the safety device 22, then through the outflow line or conduit 26 including the section 60 thereof, and thereafter through the pipe or tube 62 and the flexible hose 64 to the outlet 30 in the shower head 28.

In the region or area of the recess 50 there is provided a ventilation passage or throughpass 66 extending approximately in a radial direction and leading away from the safety device 22, i.e. through the extension 46 to the hollow space 44. This ventilation passage 66 is depicted in FIG. 1 at a location displaced through an angle of 90° to simplify the illustration, and depicted in FIG. 2 at the preferred location, i.e. at the front side of the fitting housing or body 14 facing the sink-basin 24. Below this ventilation passage 66 there extends, from the lowest location of the hollow space 44 limited by the transition portion of the housing wall 32' into the rib 42, a further ventilation passage or throughpass 66' leading through the housing wall 32'. The two ventilation passages 66 and 66' together with the hollow space 44 define an aeration or ventilation path 68 by means of which the safety device 22 is connected with ambiant air and through which water possibly leaking out of the safety device 22 can guidedly flow into the sink-basin 24. In order to avoid drip traces or marks at the fitting housing or body 14 and at the rim 24' of the sink-basin 24, it is possible, as indicated in FIG. 2 by dot-dash lines, to provide a drip pipe 70 connected with the ventilation passage or throughpass 66'. It is also conceivable to structure the ventilation channel as disclosed, for example, in Swiss Patent Application No. 04,481/89-9.

The upper housing part 34 is pivotably mounted at the lower housing part 32 for swiveling movement about a substantially vertical axis 72. The upper housing part 34 possesses a rotary or turret flange 74 which engages the upper end portion of the lower housing part 32, and comprises in the area of the rotary flange 74 a circumferential guiding groove 76, in which there engages the free end of a guide pin or bolt 78 extending through the housing wall 32' and screwed therein. The extension 46 projects beyond the upper end of the housing wall 32' and extends into the interior of the tubular upper housing part 34. In the region of the upper planar end 46' of the extension 46 projecting in an upward direction, the upper housing part 34 is bent away to form or constitute a tapered or narrowing connection piece 80 which projects inclinedly upwards. The flexible hose 64 extends through the tapered connection piece 80 and the shower head 28 is removably retained in the connection piece 80. The guide pin or bolt 78 engaging or cooperating with the guiding groove 76 firmly holds the upper housing part 34 in a vertical direction relative to the lower housing part 32, but allows for swiveling movement of the upper housing part 34 about the substantially vertical axis 72. The swiveling range of the upper housing part 34 can be limited in that the circumferential guiding groove 76 is only provided along a portion of the circumference of the rotary or turret flange 74 of the upper housing part 34.

It is to be observed that in FIG. 1 the upper housing part 34 is illustrated to be rotated or pivoted through 90° with respect to the front side of the sanitary fitting or faucet 10. Furthermore, as depicted in FIGS. 1 and 2, the water in the sink-basin or equivalent structure is conveniently denoted by reference numeral 82.

Turning attention now specifically to FIG. 3 of the drawings, the safety device 22 is shown in an enlarged illustration. The safety or check device 22 is inserted in the substantially cylindrical blind-hole-type recess 50 provided in the extension 46 projecting in an upward direction. The connecting channel or duct 52 leads through the extension 46, i.e. past the recess 50 and up to the upper planar end 46' of the extension 46. The cover element 54 with the flow groove or channel 56 is seated on the extension 46, in order to flow connect the connecting channel 52 with the recess 50. Between the upper planar end 46' and the cover element 54 there is located the sealing element 58. The section 60 of the outflow line or conduit 26 leads away from the base or bottom 50' of the recess 50 in a downward direction. The safety device 22 comprises a pipe aerator 84 and a backflow preventer 86 arranged above the pipe aerator 84.

At a substantially cylindrically hollow valve-seat element 88 of the backflow preventer 86 there is provided an inwardly projecting circumferential rib 90 at which there is formed a valve seat 90' tapered in an upward direction. This valve seat 90' cooperates with an O-ring 92 of a valve body 94. The O-ring 92 is arranged in a groove 96 of a rotationally symmetrical valve-body element 98 provided within the valve-seat element 88. The valve-body element 98 is prestressed in an upward direction and against the valve seat 90' by means of a compression spring 100. Above the O-ring 92 located in the groove 96 there is formed a stop face or surface 102 at the rotationally symmetrical valve-body element 98, such stop face or surface 102 coacting with a counter-stop face or surface 102' provided at the inwardly projecting circumferential rib 90, in order to ensure that the 0-ring 92 definedly rests at the valve seat 90' and to thus prevent a wedging of the valve body 94 at the valve seat 90'

The rotationally symmetrical valve-body element 98 comprises a downwardly projecting guide shaft or shank 104 which is displaceably guided in a substantially vertical direction in a tubular guiding element 106. This guiding element 106 is mounted at a ring 110 by mean of three radially extending ribs 108, the ring 110 being screwed from below into the cylindrically hollow valve-seat element 88. However, it is also feasible to snap in the ring 110 at the valve-seat element 88. The compression spring 100 is supported at the bottom end remote from the valve-body element 98, i.e. at the three radially extending ribs 108. The valve-seat element 88 is inserted in a sleeve-shaped supporting member 112 and effectively supported contrary to the predetermined direction of flow S of mixed water by means of a radially and inwardly projecting annular rim 112' of the supporting member 112. An 0-ring type sealing member 114 prevents throughflow of water between the valve-seat element 88 and the supporting member 112. The supporting member 112 bears with its outer wall against the extension 46 and a further sealing member 114' prevents a throughflow of water between the supporting member 112 and the extension 46. At the supporting member 112 there is formed a downwardly projecting supporting leg 116 which bears upon a body element 118 of the pipe aerator 84.

The body element 118, structured to be substantially cylindrical, is supported at the base or bottom 50' of the recess 50 by means of a collar or rim 118' which projects in a downward direction at the lower end of the body element 118. Centrically to the axis 50" of the recess 50, there is formed at the body element 118 a pocket or blind hole 120 which is open toward the backflow preventer 86. A ventiduct 122 in alignment with the ventilation passage or throughpass 66 in the extension 46 leads out from the pocket or blind hole 120. A sealing element 124 extends into the pocket or blind hole 120 and is displaceably guided in a vertical direction within the pocket or blind hole 120 by means of cross-wise formed guiding ribs 126. Above these guiding ribs 126, the sealing element 124 is structured to be rotationally symmetrical and comprises a circumferential groove 128 in which there is held or retained a further O-ring 92'. This O-ring 92' cooperates with the upper end 118" of the body element 118, such upper end 118" being structured as a valve seat. For this purpose, the O-ring 92' projects, as viewed in a radial direction, beyond the portion of the sealing element 124 extending into the pocket or blind hole 120.

Circularly around the pocket or blind hole 120 there are provided flow passages 130 extending substantially parallel to the axis 50", in order to deliver mixed water flowing through the backflow preventer 86 in the predetermined direction of flow S to the section 60 of the outflow line or conduit 26. In the position of the sealing element 124 shown in FIG. 3, the sealing element 124 closes a ventilation aperture 132 bounded by the upper end 118" of the body element 118, such ventilation aperture 132 being connected with the ambiant air via the aeration or ventilation path 68.

Under normal operating conditions, the ventilation aperture 132 is closed. When the control cartridge 16 is open, mixed water flows through the connecting channel or duct 52 and through the flow groove or channel 56 to the recess 50. The valve body 94 prestressed contrary to the predetermined direction of flow S of mixed water is lifted off from the valve seat 90', so that mixed water can flow through the hollow valve-seat element 88 and through the flow passages 130 to the outflow line or conduit 26 and ultimately to the outlet 30.

When the extremely seldom case occurs that at the feed side a negative pressure builds up and the control cartridge 16 is open, the water will try to flow back in a direction contrary to the predetermined direction of flow S of mixed water. Such backflow or return flow will be precluded by the backflow preventer 86 in that the valve body 94 with the O-ring 92 comes to bear against the valve seat 90', thus cutting off the flow path 65 of mixed water. Under conditions that render possible a backflow of water, a back-suction of water into the supply or feed lines 20 and 20' is thus precluded. No water 82 present in the sink-basin 24 can be sucked back to the supply or feed lines 20 and 20' when the shower head 28 is incidentally left lying in the water. Nevertheless, if negative pressure should build up in the portion of the water flow path 65 arranged downstream of the sealing element 124, viewed in the predetermined direction of flow S, the sealing element 124 will be lifted off to open the ventilation aperture 132. In this manner, the outflow line or conduit 26 is ventilated when conditions may render possible a water backflow.

It is to be observed that for closing the backflow preventer 86 under conditions that render possible back or return flow, there is available the force of the compression spring 100 and in addition thereto a pressure corresponding to the water column of the height H. If the sink-basin 24 is not filled up to the horizontally extending rim 24', such additional pressure is respectively greater. The safety device 22 is adequately located approximately 15 cm above the highest possible water level in the sink-basin or wash-basin 24.

Similarly structured pipe interruptors and pipe aerators are described, for example, in German Standard DIN 3266, part 1, published July 1986. Naturally, the safety device 22 of the present invention can also comprise a pipe interruptor as disclosed in the aforementioned German Standard DIN 3266.

The safety device 22 of the sanitary fitting 10 constructed according to the invention can be also structured in a manner different to that illustrated in FIG. 3 and different to the constructions disclosed in the aforementioned German Standard DIN 3266. Particularly, the safety device 22 can be constructed, for example, as disclosed in Swiss Patent Application No. 00,696/90-4 and Swiss Patent Application No. 00,972/90-2.

While there are shown and described preferred embodiments of the invention, it is to be understood that the invention is not limited thereto, but may be otherwise variously embodied and practiced within the scope of the following claims. ACCORDINGLY,

WHAT I CLAIM IS:

1. A sanitary fitting provided for at least one supply line and containing an outflow line leading to an outlet, comprising:

a fitting housing having lateral ends and a front side;

a control cartridge arranged in said fitting housing and possessing an inlet side;

said control cartridge being structured to be actuatable from one of said lateral ends of said fitting housing and connected at said inlet side with the at least one supply line;

said control cartridge serving to regulate water flowing through the sanitary fitting to the outlet;

water flowing through the sanitary fitting to the outlet having a predetermined direction of flow;

a safety device provided in said fitting housing and arranged, viewed with respect to said predetermined direction of flow, downstream of said control cartridge;

said safety device serving to prevent backflow of water into the at least one supply line;

said safety device having a ventilation aperture which in the presence of normal water flow is closed and, under conditions rendering possible backflow of water, is open for ventilating at least the outflow line connecting said safety device with the outlet; and said safety device being provided above said control cartridge.

2. The sanitary fitting as defined in claim 1, further including:

a pull-out hose shower containing the outlet;

the outflow line possessing a section leading away from said safety device and extending within said fitting housing in a downward direction; and said section within said fitting housing being guided past said control cartridge.

3. The sanitary fitting as defined in claim 2, wherein:

said section of the outflow line extending within said fitting housing constitutes an outflow-line section formed at said fitting housing.

4. The sanitary fitting as defined in claim 2, further including:

an aeration path provided in said fitting housing and flow-connected with said ventilation aperture of said safety device.

5. The sanitary fitting as defined in claim 4, wherein:

said aeration path provided in said fitting housing leads out of said fitting housing at said front side.

6. The sanitary fitting as defined in claim 4, wherein:

said fitting housing comprises a lower housing part at which there are arranged said control cartridge and said safety device;

said fitting housing comprises an upper housing part through which said section of the outflow line extends;

said upper housing part having a substantially vertical axis;

said upper housing part being pivotably mounted at said lower housing part for swiveling movement about said substantially vertical axis;

said upper housing part having a housing portion selectively located above said safety device or within the range of said safety device; and said upper housing part being bent away at said housing portion to form a connection piece projecting in an inclined upward direction and leading to the outlet.

7. The sanitary fitting as defined in claim 4, wherein:

said fitting housing comprises a lower housing part at which there are arranged said control cartridge and said safety device;

said fitting housing comprises an upper housing part through which said section of the outflow line extends;

said upper housing part having a substantially vertical axis;

said upper housing part being pivotably mounted at said lower housing part for swiveling movement about said substantially vertical axis;

said upper housing part having a housing portion selectively located above said safety device or within the range of said safety device;

said pull-out hose shower having a shower head containing the outlet; and said upper housing part being bent away at said housing portion to form a connection piece projecting in an inclined upward direction and removably holding said shower head.

8. The sanitary fitting as defined in claim 7, further including:

a connecting channel provided in said lower housing part of said fitting housing and possessing an open end;

said lower housing part having portions defining a recess provided for said safety device and having an open upper end;

said connecting channel leading away from said control cartridge and leading past said recess;

a cover element for mutually covering said open end of said connecting channel and said open upper end of said recess such that said connecting channel and said recess are in flow connection with each other; and said section of said outflow line leading away from said safety device being arranged to lead away from said recess provided for said safety device.

9. The sanitary fitting as defined in claim 7, wherein:

said lower housing part comprises an extension projecting into said upper housing part;

said extension located within said upper housing part having portions defining a recess;

said safety device being arranged in said recess;

said extension comprising a connecting channel which extends through said extension from said control cartridge and is guided past said recess;

said connecting channel and said recess having respective open upper ends;

said extension comprising a cover element for mutually covering said open upper ends of said connecting channel and said recess, respectively, such that said connecting channel and said recess are in flow connection with each other; and said section of the outflow line extending within said extension and leading away from said recess.

10. The sanitary fitting as defined in claim 9, wherein:

the water having said predetermined direction of flow defines a flow path of water extending from said control cartridge through said connecting channel to said safety device, then through the outflow line, and thereafter through said pull-out hose shower to the outlet in said shower head; and said safety device comprises a pipe interruptor provided in said flow path of water and a pipe aerator provided in said aeration path.

11. The sanitary fitting as defined in claim 9, wherein:

the water having said predetermined direction of flow defines a flow path of water extending from said control cartridge through said connecting channel to said safety device, then through the outflow line, and thereafter through said pull-out hose shower to the outlet in said shower head; and said safety device comprises a backflow preventer provided in said flow path of water and a pipe aerator provided in said aeration path.

12. The sanitary fitting as defined in claim 8, wherein:

said recess is substantially vertically arranged;

the water having said predetermined direction of flow defines a flow path of water extending from said control cartridge through said connecting channel to said safety device, then through the outflow line, and thereafter through said pull-out hose shower to the outlet in said shower head;

said safety device being inserted in said recess and comprising a pipe aerator and a backflow preventer;

said backflow preventer being arranged above said pipe aerator and provided in said flow path of water;

said backflow preventer comprising a valve body and a valve seat;

said valve body being prestressed against said valve seat and cooperating with said valve seat to let through water flowing in said predetermined direction of flow and to automatically close under conditions rendering possible a backflow;

said pipe aerator comprising a throughpassage connected with said aeration path and bounded by said ventilation aperture, and further comprising a sealing element closing said ventilation aperture under normal operating conditions; and said sealing element being structured to be lifted from said ventilation aperture under conditions that render possible a backflow of water, in order to ventilate the part of the outflow line located downstream of said backflow preventer, viewed with respect to said predetermined direction of flow.

13. The sanitary fitting as defined in claim 9, wherein:

said recess is substantially vertically arranged;

the water having said predetermined direction of flow defines a flow path of water extending from said control cartridge through said connecting channel to said safety device, then through the outflow line, and thereafter through said pull-out hose shower to the outlet in said shower head;

said safety device being inserted in said recess and comprising a pipe aerator and a backflow preventer;

said backflow preventer being arranged above said pipe aerator and provided in said flow path of water;

said backflow preventer comprising a valve body and a valve seat;

said valve body being prestressed against said valve seat and cooperating with said valve seat to let through water flowing in said predetermined direction of flow and to automatically close under conditions rendering possible a backflow;

said pipe aerator comprising a throughpassage connected with said aeration path and bounded by said ventilation aperture, and further comprising a sealing element closing said ventilation aperture under normal operating conditions; and said sealing element being structured to be lifted from said ventilation aperture under conditions that render possible a backflow of water, in order to ventilate the part of the outflow line located downstream of said backflow preventer, viewed with respect to said predetermined direction of flow.

* * * * *